US011076463B1

(12) United States Patent
Chiang et al.

(10) Patent No.: US 11,076,463 B1
(45) Date of Patent: Jul. 27, 2021

(54) CURRENT DRIVING DEVICE

(71) Applicant: MACROBLOCK, INC., Hsinchu (TW)

(72) Inventors: Ting-Ta Chiang, Hsinchu (TW); Wen-Ger Wong, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

(21) Appl. No.: 17/248,718

(22) Filed: Feb. 4, 2021

(30) Foreign Application Priority Data

Apr. 8, 2020 (TW) ..... 109111793

(51) Int. Cl.
*H05B 45/10* (2020.01)
*H05B 45/32* (2020.01)

(52) U.S. Cl.
CPC ..... *H05B 45/32* (2020.01); *H05B 45/10* (2020.01)

(58) Field of Classification Search
None
See application file for complete search history.

(56) References Cited

U.S. PATENT DOCUMENTS 10,314,131 B1 * 6/2019 Chen ..... H05B 45/10
2013/0088170 A1 * 4/2013 Lu ..... H05B 45/10 315/307

* cited by examiner

*Primary Examiner* — Dedei K Hammond
(74) *Attorney, Agent, or Firm* — Akerman LLP; Peter A. Chiabotti

(57) ABSTRACT

A current driving device includes a switch, a current generator and a brightness divider. The switch is coupled between the current generator and a light emitting element, and switches between conduction and non-conduction based on a pulse signal. Based on a magnitude control signal, the current generator generates a drive current that has a magnitude related to the magnitude control signal, and that flows through the light emitting element when the switch conducts. The brightness divider is coupled to the switch and the current generator, and generates the pulse signal and the magnitude control signal based on a brightness value such that average brightness of the light emitting element is related to the brightness value.

7 Claims, 8 Drawing Sheets

CURRENT DRIVING DEVICE

CROSS-REFERENCE TO RELATED APPLICATION

This application claims priority of Taiwanese Patent Application No. 109111793, filed on Apr. 8, 2020.

FIELD

The disclosure relates to a current driving device, and more particularly to a current driving device for driving a light emitting element.

BACKGROUND

A first conventional current driving device for driving a light emitting diode (LED) string includes a current source and a switch that are coupled to the LED string in series. The current source generates a drive current with a fixed magnitude. The switch receives a control signal with a variable pulse width, and switches between conduction and non-conduction based on the control signal. Within each pulse of the control signal, the switch conducts, the drive current flows through the LED string, and the LED string emits light with fixed intensity. Outside each pulse of the control signal, the switch does not conduct, no current flows through the LED string, and the LED string does not emit light. Therefore, average brightness of the LED string in a switching cycle of the control signal is linearly correlated to the pulse width of the control signal. For the first conventional current driving device, only a frequency of a clock signal that is used to generate the control signal can be increased to enhance resolution of the average brightness of the LED string. However, when the frequency of the clock signal is too high, the linear correlation between the pulse width of the control signal and the average brightness of the LED string would be degraded because of transient response characteristics of the LED string.

A second conventional current driving device for driving an LED string includes a controlled current source coupled to the LED string, and a signal combiner coupled to the controlled current source. The signal combiner receives a pulse dimming signal and a magnitude dimming signal that are generated from a brightness value, and combines the pulse dimming signal and the magnitude dimming signal into a control signal for controlling the controlled current source. The control signal has a pulse width correlated to the pulse dimming signal, and a constant pulse height correlated to the magnitude dimming signal. The controlled current source switches, based on the control signal, between generating a drive current that flows through the LED string and not generating the drive current. Within each pulse of the control signal, the drive current is generated and has a constant magnitude correlated to the pulse height of the control signal, and the LED string emits light with constant intensity correlated to the magnitude of the drive current. Outside each pulse of the control signal, the drive current is not generated, and the LED string does not emit light. Therefore, average brightness of the LED string in a switching cycle of the control signal is correlated to the brightness value. For the second conventional current driving device, although the magnitude of the drive current is modulated to enhance resolution of the average brightness of the LED string, the pulse dimming signal and the magnitude dimming signal have to be combined into the control signal.

SUMMARY

Therefore, an object of the disclosure is to provide a current driving device that can alleviate at least one drawback of the prior art.

According to the disclosure, the current driving device is adapted to drive a light emitting element based on a brightness value, and includes a switch, a current generator and a brightness divider. The switch is adapted to be coupled to the light emitting element, is to receive a pulse signal, and switches between conduction and non-conduction based on the pulse signal. The switch conducts within each pulse of the pulse signal, and does not conduct outside each pulse of the pulse signal. The current generator is coupled to the switch, is to receive a magnitude control signal, and generates a drive current based on the magnitude control signal. The drive current has a magnitude related to the magnitude control signal, and flows through the light emitting element when the switch conducts. The brightness divider is coupled to the switch and the current generator, is to receive the brightness value, and generates the pulse signal and the magnitude control signal based on the brightness value for receipt by the switch and the current generator such that average brightness of the light emitting element in a switching cycle of the pulse signal is related to the brightness value.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
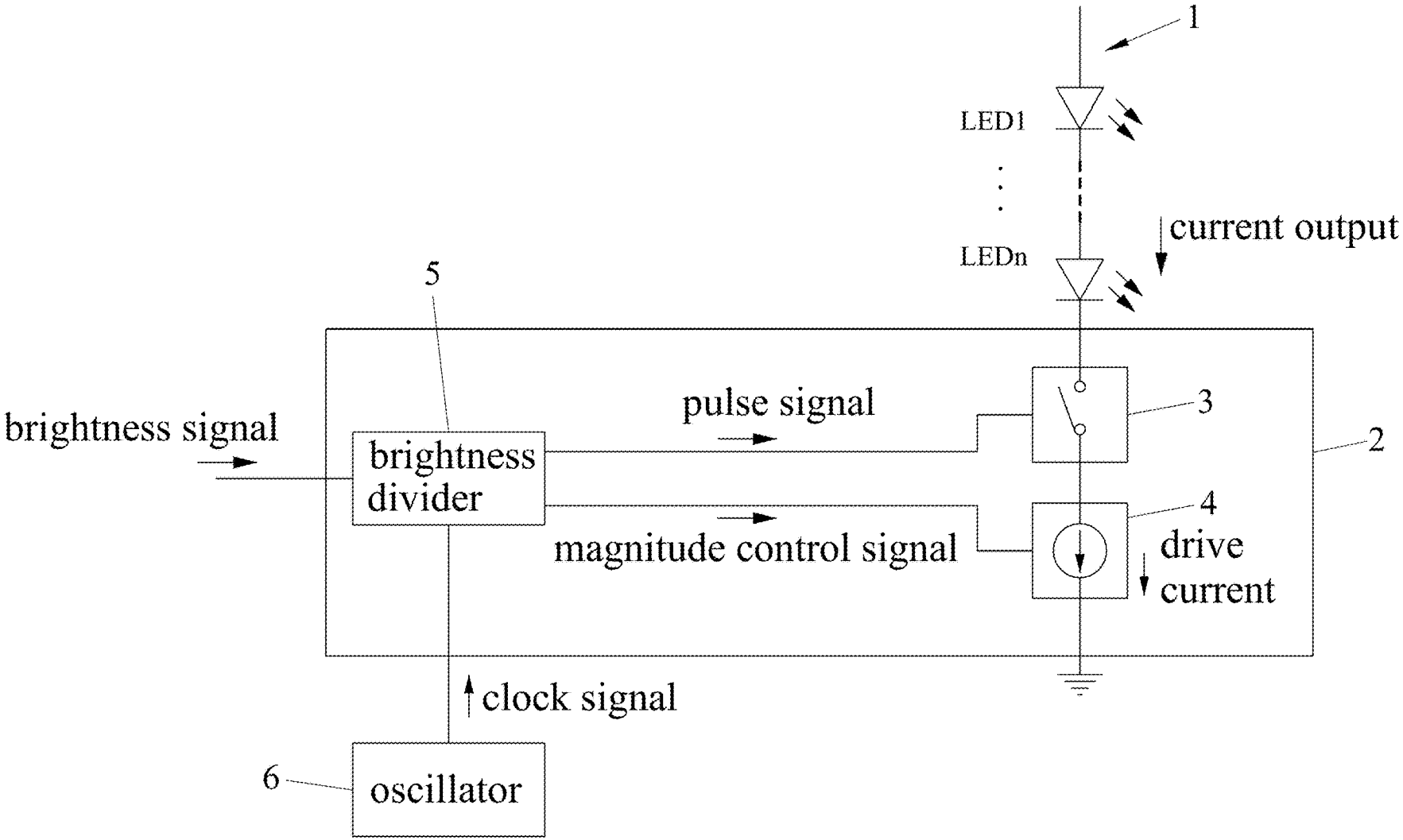
FIG. 1 is a circuit block diagram illustrating an embodiment of a current driving device according to the disclosure.

Referring to FIG. 1, an embodiment of a current driving device 2 according to the disclosure is adapted to drive a light emitting element 1 based on a brightness value, and includes a switch 3, a current generator 4 and a brightness divider 5. In this embodiment, the light emitting element 1 is a light emitting diode (LED) string that includes multiple LEDs (LED1-LEDn) of the same color or different colors (e.g., red, green, blue, white, etc.). However, in other embodiments, the light emitting element 1 may be a single LED.

The switch 3 is adapted to be coupled to the light emitting element 1, is to receive a pulse signal, and switches between conduction and non-conduction based on the pulse signal. The switch 3 conducts within each pulse of the pulse signal, and does not conduct outside each pulse of the pulse signal.

The current generator 4 is coupled to the switch 3, is to receive a magnitude control signal, and generates a drive current based on the magnitude control signal. The drive current has a magnitude related to the magnitude control signal. When the switch 3 conducts, the drive current flows through the light emitting element 1, and the light emitting element 1 emits light with intensity related to the magnitude of the drive current. When the switch 3 does not conduct, no current flows through the light emitting element 1, and the light emitting element 1 does not emit light. In other words, a current output provided by the current driving device 2 to drive the light emitting element 1 has a magnitude that is equal to the magnitude of the drive current when the switch 3 conducts, and that is zero when the switch 3 does not conduct.

The brightness divider 5 is coupled to the switch 3 and the current generator 4, is to receive a brightness signal containing the brightness value, and is to further receive a clock signal from an oscillator 6. The brightness divider 5 generates the pulse signal and the magnitude control signal based on the brightness value and the clock signal for receipt by the switch 3 and the current generator 4, such that average brightness of the light emitting element 1 in a switching cycle of the pulse signal is related to the brightness value. It should be noted that the oscillator 6 is external to the current driving device 2 in this embodiment, but may be included in the current driving device 2 in other embodiments.

In this embodiment, the brightness divider 5 can generate the pulse signal and the magnitude control signal in two different ways.

In a first way, the brightness divider 5 generates the pulse signal and the magnitude control signal further based on a predetermined reference value (N) (e.g., an integer greater than one). The pulse signal has a pulse width that is a number (A) multiplied by a width (T) of a predetermined time interval (i.e., A×T). The width (T) of the predetermined time interval is a period of the clock signal. When $$Y = BV - \left\lfloor \frac{BV}{N} \right\rfloor \times N = 0$$

(where "BV" denotes the brightness value), $$A = \left\lfloor \frac{BV}{N} \right\rfloor.$$

In addition, the magnitude control signal is generated in such a way that, within each pulse of the pulse signal, the magnitude of the drive current is the predetermined reference value (N) multiplied by a predetermined current value. When $$Y \neq 0, A = \left\lfloor \frac{BV}{N} \right\rfloor + 1,$$

and each pulse of the pulse signal is divided into a first time interval with a width of (A−1)×T and a second time interval with a width of 1×T (i.e., the width of the first time interval is a number (A−1) multiplied by the width of the second time interval). In addition, the magnitude control signal is generated in such a way that, within each pulse of the pulse signal, the magnitude of the drive current is the predetermined reference value (N) multiplied by the predetermined current value in the first time interval, and is the number (Y) multiplied by the predetermined current value in the second time interval.

Figure 2:
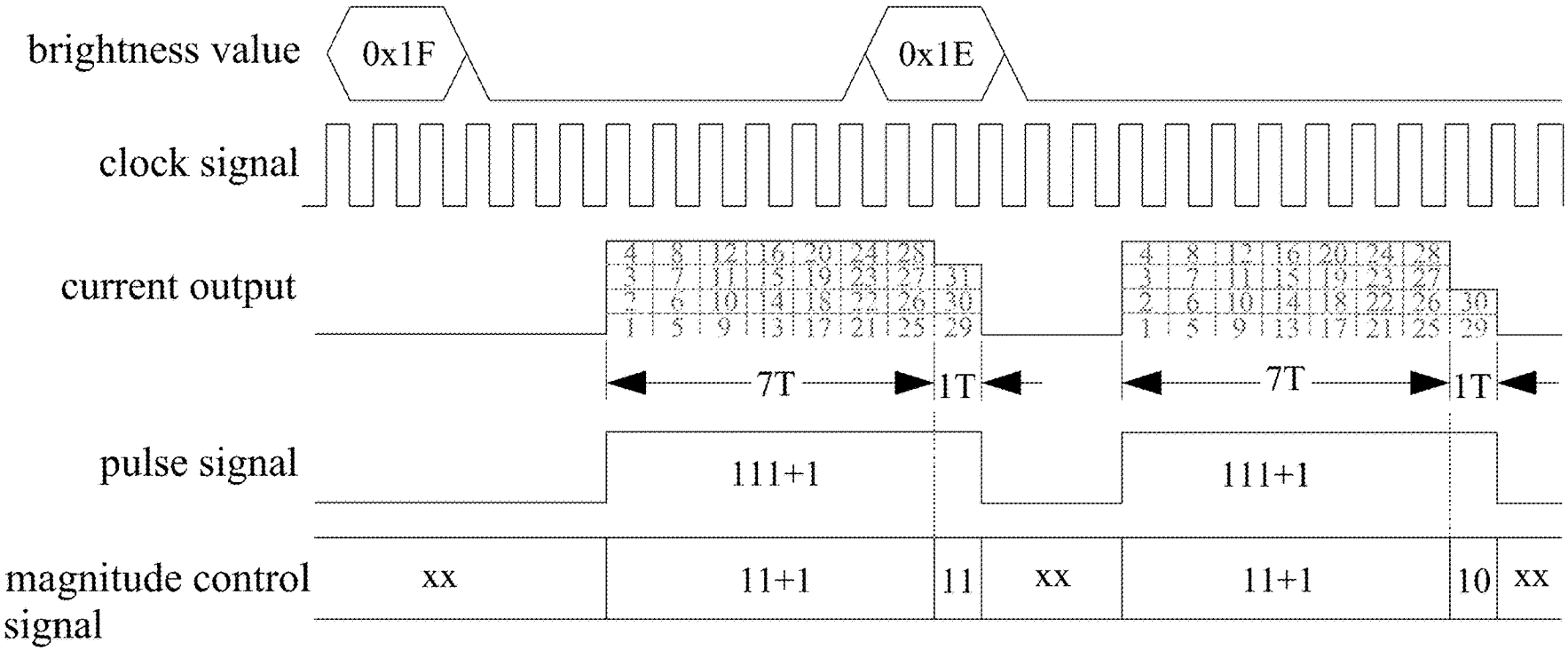
FIGS. 2-4 are exemplary timing diagrams illustrating the embodiment generating a pulse signal and a magnitude control signal in a first way.
Figure 3:
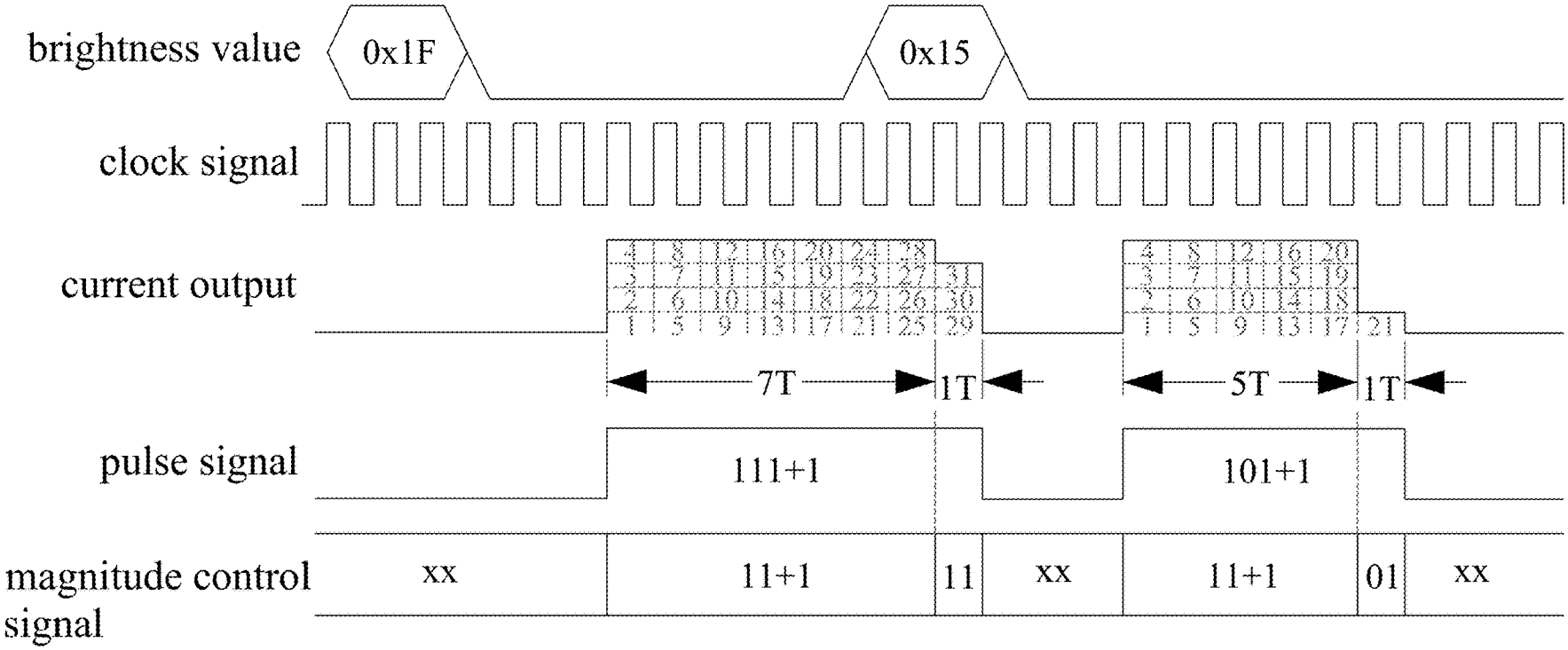
Figure 4:
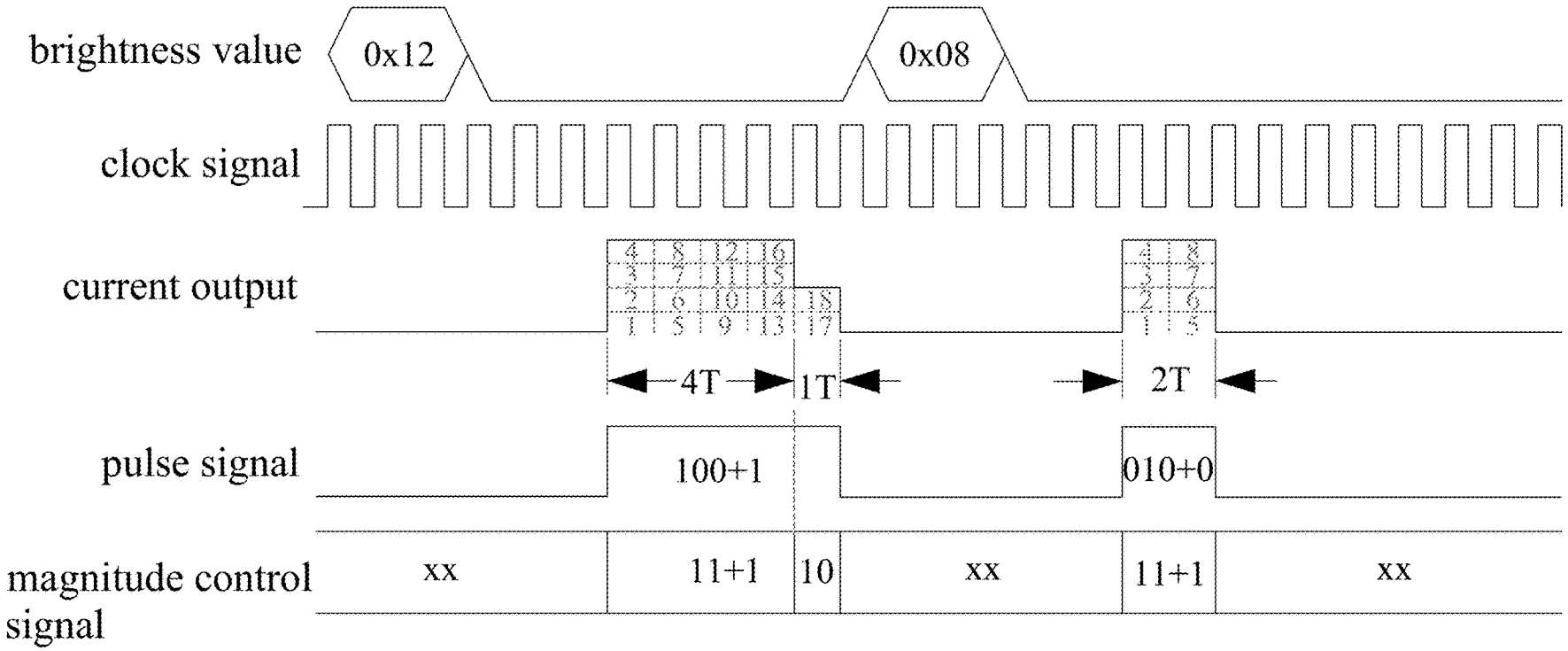

FIGS. 2 to 4 illustrate an example in which the brightness signal is 5-bit wide (i.e., the brightness value (BV) is smaller than thirty-two), the predetermined reference value (N) is four, and the brightness divider 5 (see FIG. 1) operates on rising edges of the clock signal. It should be noted that, in other examples, the brightness divider 5 (see FIG. 1) may operate on falling edges of the clock signal.

As shown in FIG. 2, when the brightness value (BV) is thirty-one (i.e., 0x1F), $$Y = 31 - \left\lfloor \frac{31}{4} \right\rfloor \times 4 = 3, A = \left\lfloor \frac{31}{4} \right\rfloor + 1 = 8,$$

the pulse width of the pulse signal is 8×T, the pulse of the pulse signal is divided into a first time interval with a width of 7×T and a second time interval with a width of 1×T, and within the pulse of the pulse signal, the magnitude of the drive current is four times the predetermined current value in the first time interval, and is three times the predetermined current value in the second time interval. When the brightness value (BV) is thirty (i.e., 0x1E), $$Y = 30 - \left\lfloor \frac{30}{4} \right\rfloor \times 4 = 2,$$

$$A = \left\lfloor \frac{30}{4} \right\rfloor + 1 = 8,$$

the pulse width of the pulse signal is 8×T, the pulse of the pulse signal is divided into a first time interval with a width of 7×T and a second time interval with a width of 1×T, and within the pulse of the pulse signal, the magnitude of the drive current is four times the predetermined current value in the first time interval, and is two times the predetermined current value in the second time interval.

As shown in FIG. 3, when the brightness value (BV) is twenty-one (i.e., 0x15), $$Y = 21 - \left\lfloor \frac{21}{4} \right\rfloor \times 4 = 1, A = \left\lfloor \frac{21}{4} \right\rfloor + 1 = 6,$$

the pulse width of the pulse signal is 6×T, the pulse of the pulse signal is divided into a first time interval with a width of 5×T and a second time interval with a width of 1×T, and within the pulse of the pulse signal, the magnitude of the drive current is four times the predetermined current value in the first time interval, and is the predetermined current value in the second time interval.

As shown in FIG. 4, when the brightness value (BV) is eighteen (i.e., 0x12), $$Y = 18 - \left\lfloor \frac{18}{4} \right\rfloor \times 4 = 2, A = \left\lfloor \frac{18}{4} \right\rfloor + 1 = 5,$$

the pulse width of the pulse signal is 5×T, the pulse of the pulse signal is divided into a first time interval with a width of 4×T and a second time interval with a width of 1×T, and within the pulse of the pulse signal, the magnitude of the drive current is four times the predetermined current value in the first time interval, and is two times the predetermined current value in the second time interval. When the brightness value (BV) is eight (i.e., 0x08), $$Y = 8 - \left\lfloor \frac{8}{4} \right\rfloor \times 4 = 0,\ A = \left\lfloor \frac{8}{4} \right\rfloor = 2,$$

the pulse width of the pulse signal is 2×T, and within the pulse of the pulse signal, the magnitude of the drive current is four times the predetermined current value.

Referring back to FIG. 1, in a second way, the brightness divider 5 generates the pulse signal and the magnitude control signal further based on a predetermined threshold value (TH) (e.g., an integer greater than one). When the brightness value (BV) is greater than or equal to the predetermined threshold value (TH) (i.e., BV≥TH), the pulse width of the pulse signal is the brightness value (BV) multiplied by the width (T) of the predetermined time interval (i.e., BV×T), and the magnitude control signal is generated in such a way that, within each pulse of the pulse signal, the magnitude of the drive current is the predetermined threshold value (TH) multiplied by the predetermined current value. When the brightness value (BV) is smaller than the predetermined threshold value (TH) (i.e., BV<TH), the pulse width of the pulse signal is the predetermined threshold value (TH) multiplied by the width (T) of the predetermined time interval (i.e., TH×T), and the magnitude control signal is generated in such a way that, within each pulse of the pulse signal, the magnitude of the drive current is the brightness value (BV) multiplied by the predetermined current value.

Figure 5:
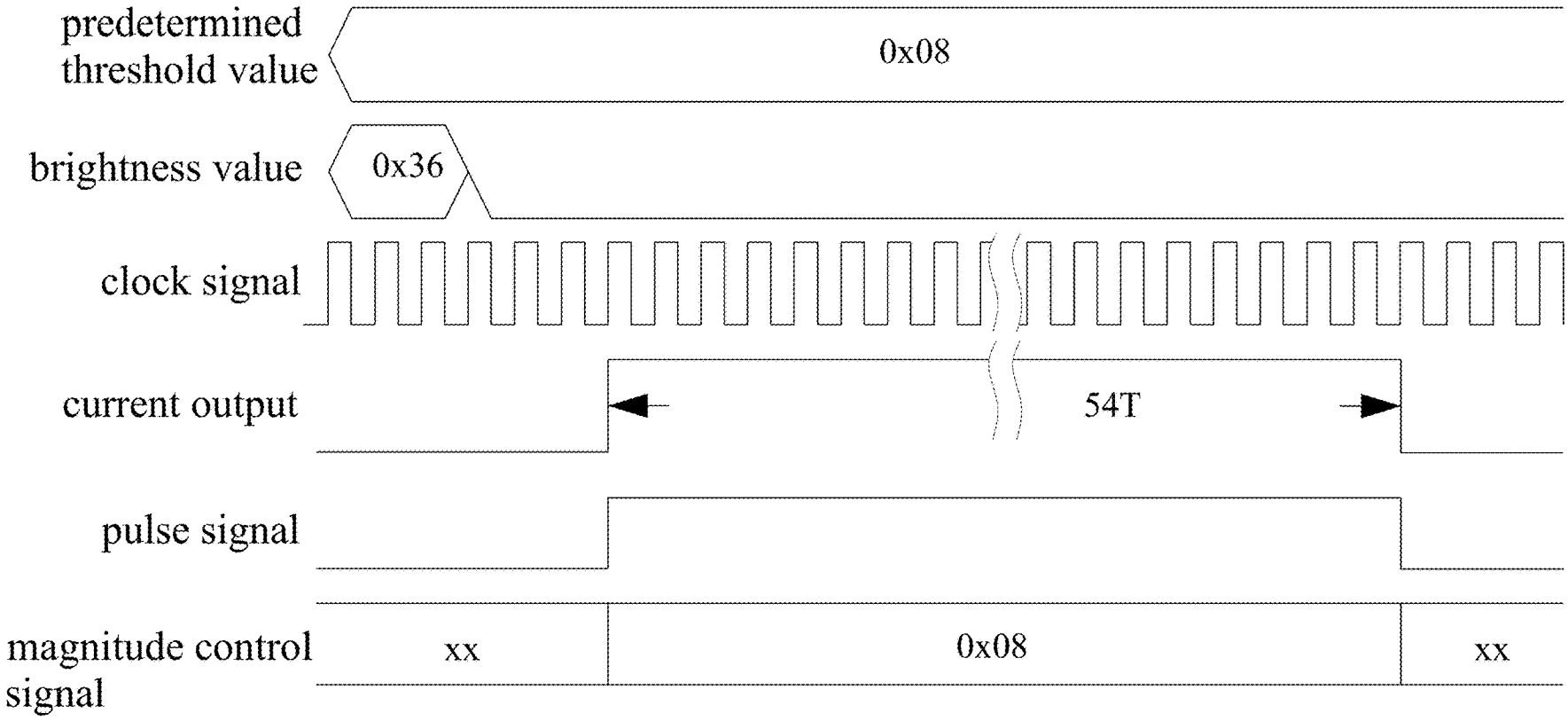
FIGS. 5-7 are exemplary timing diagrams illustrating the embodiment generating the pulse signal and the magnitude control signal in a second way.
Figure 6:
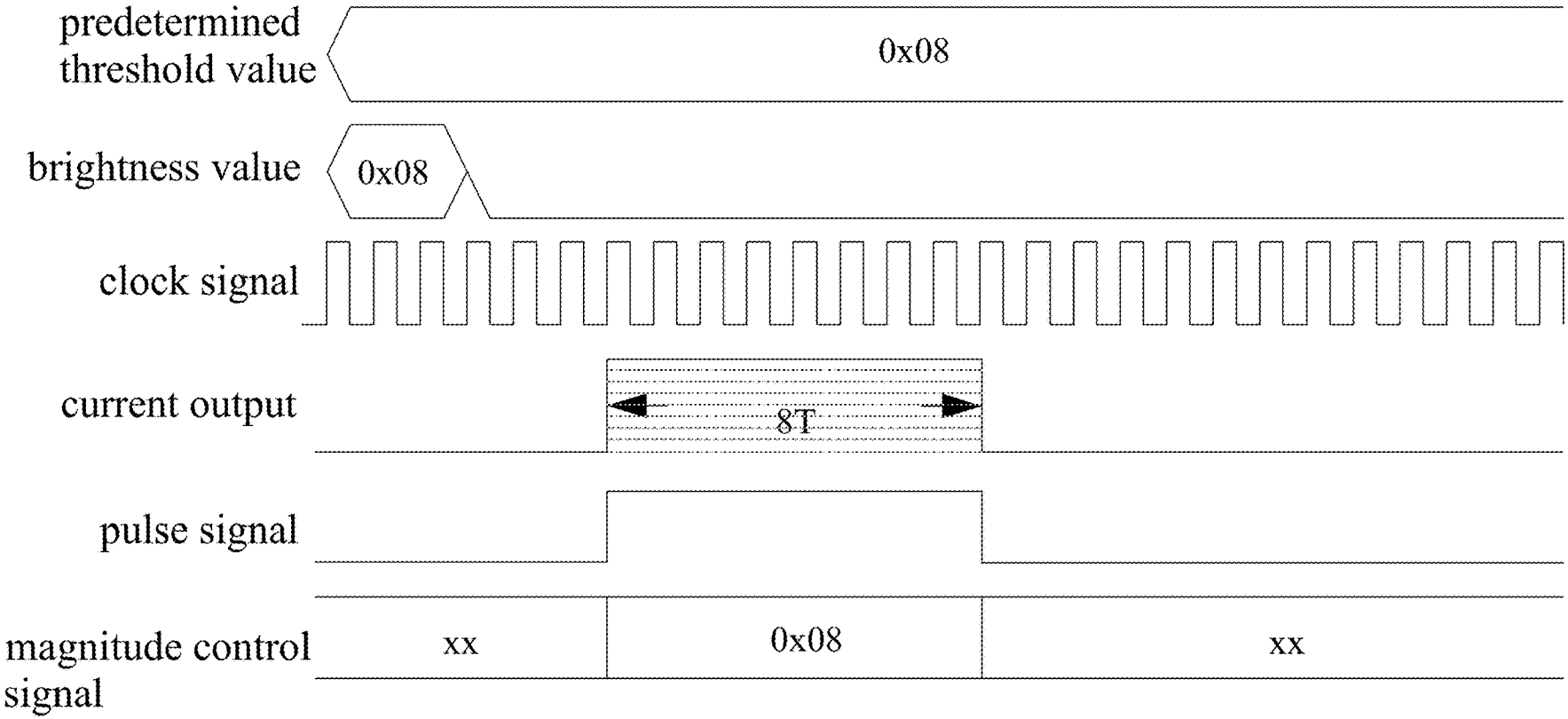
Figure 7:
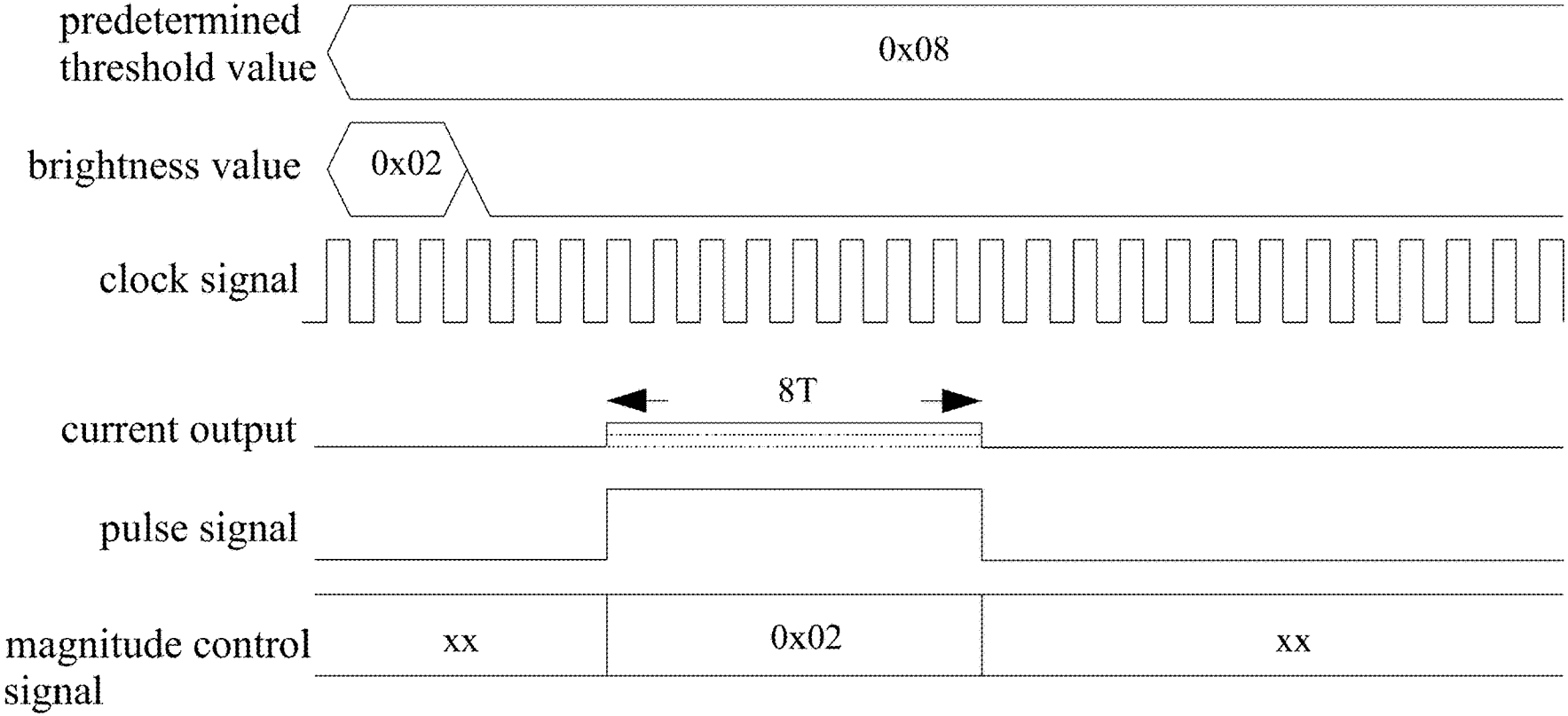

FIGS. 5 to 7 illustrate an example in which the predetermined threshold value (TH) is eight (i.e., 0x08), and the brightness divider 5 (see FIG. 1) operates on the rising edges of the clock signal. It should be noted that, in other examples, the brightness divider 5 (see FIG. 1) may operate on the falling edges of the clock signal.

As shown in FIG. 5, when the brightness value (BV) is fifty-four (i.e., 0x36), the pulse width of the pulse signal is 54×T, and within the pulse of the pulse signal, the magnitude of the drive current is eight times the predetermined current value.

As shown in FIG. 6, when the brightness value (BV) is eight (i.e., 0x08), the pulse width of the pulse signal is 8×T, and within the pulse of the pulse signal, the magnitude of the drive current is eight times the predetermined current value.

As shown in FIG. 7, when the brightness value (BV) is two (i.e., 0x02), the pulse width of the pulse signal is 8×T, and within the pulse of the pulse signal, the magnitude of the drive current is two times the predetermined current value.

Referring back to FIG. 1, in view of the above, in this embodiment, by virtue of the switch 3 switching between conduction and non-conduction based on the pulse signal, by virtue of the current generator 4 generating the drive current based on the magnitude control signal, and by virtue of the brightness divider 5 generating the pulse signal and the magnitude control signal based on the brightness value, resolution of the average brightness of the light emitting element 1 can be enhanced by modulating the magnitude control signal while keeping a frequency of the clock signal unchanged, and it is not necessary to combine the pulse signal and the magnitude control signal into a single signal.

Figure 8:
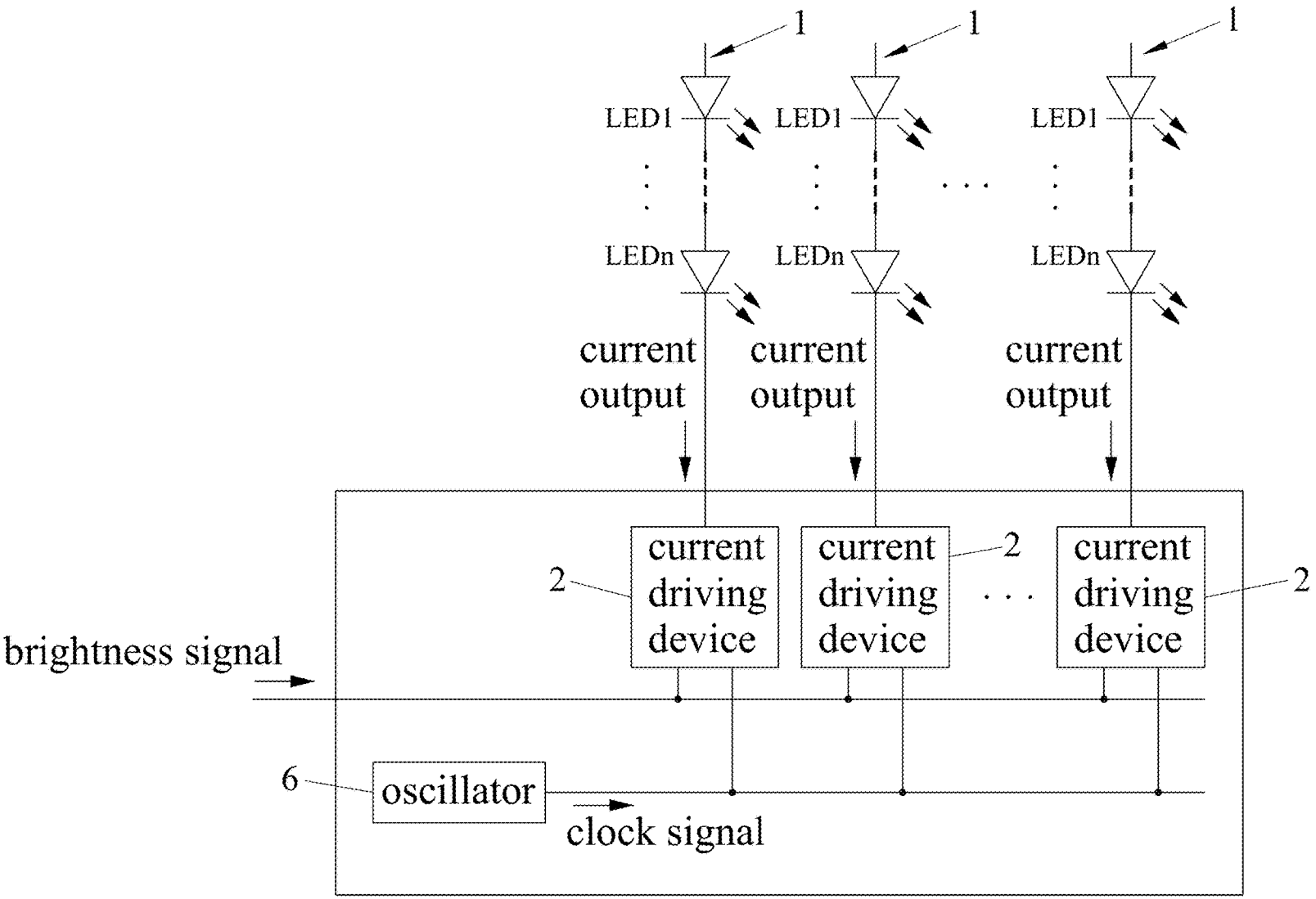
FIG. 8 is a circuit block diagram illustrating application of the embodiment.

Referring to FIG. 8, in application, a plurality of the current driving devices 2 can be used to respectively drive a plurality of the light emitting elements 1. Each of the current driving devices 2 may drive the respective one of the light emitting elements 1 based on a respective brightness value, so respective average brightnesses of the light emitting elements 1 can be different. Alternatively, each of the current driving devices 2 may drive the respective one of the light emitting elements 1 based on a common brightness value, so the respective average brightnesses of the light emitting elements 1 are the same.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A current driving device adapted to drive a light emitting element based on a brightness value, and comprising:

a switch adapted to be coupled to the light emitting element, to receive a pulse signal, and switching between conduction and non-conduction based on the pulse signal, said switch conducting within each pulse of the pulse signal and not conducting outside each pulse of the pulse signal;

a current generator coupled to said switch, to receive a magnitude control signal, and generating a drive current based on the magnitude control signal, the drive current having a magnitude related to the magnitude control signal, and flowing through the light emitting element when said switch conducts; and a brightness divider coupled to said switch and said current generator, to receive the brightness value, and generating the pulse signal and the magnitude control signal based on the brightness value for receipt by said switch and said current generator such that average brightness of the light emitting element in a switching cycle of the pulse signal is related to the brightness value.

2. The current driving device of claim 1, wherein:

the pulse signal has a pulse width that is a number (A) multiplied by a width of a predetermined time interval; and $$A = \left\lfloor \frac{BV}{N} \right\rfloor$$

when $$Y = BV - \left\lfloor \frac{BV}{N} \right\rfloor \times N = 0,$$

and $$A = \left\lfloor \frac{BV}{N} \right\rfloor + 1$$

when Y≠0, where BV denotes the brightness value, and N denotes a predetermined reference value.

3. The current driving device of claim 2, wherein, when Y=0:

within each pulse of the pulse signal, the magnitude of the drive current is the predetermined reference value multiplied by a predetermined current value.

4. The current driving device of claim 2, wherein, when Y≠0:

each pulse of the pulse signal is divided into a first time interval and a second time interval; and within each pulse of the pulse signal, the magnitude of the drive current is the predetermined reference value multiplied by a predetermined current value in the first time interval, and is the number (Y) multiplied by the predetermined current value in the second time interval, and the first time interval has a width that is a number (A−1) multiplied by a width of the second time interval.

5. The current driving device of claim 1, wherein said brightness divider generates the pulse signal and the magnitude control signal further based on a predetermined threshold value.

6. The current driving device of claim 5, wherein, when the brightness value is greater than or equal to the predetermined threshold value:

the pulse signal has a pulse width that is the brightness value multiplied by a width of a predetermined time interval; and within each pulse of the pulse signal, the magnitude of the drive current is the predetermined threshold value multiplied by a predetermined current value.

7. The current driving device of claim 5, wherein, when the brightness value is smaller than the predetermined threshold value:

the pulse signal has a pulse width that is the predetermined threshold value multiplied by a width of a predetermined time interval; and within each pulse of the pulse signal, the magnitude of the drive current is the brightness value multiplied by a predetermined current value.

* * * * *